US008941540B2

(12) United States Patent
Harper et al.

(10) Patent No.: US 8,941,540 B2
(45) Date of Patent: Jan. 27, 2015

(54) ANTENNA ARRAY

(75) Inventors: Richard John Harper, Chelmsford (GB); Gareth Michael Lewis, Colchester (GB); Robert Alan Lewis, Maldon (GB); Gary David Panaghiston, Billericay (GB); Larry Brian Tween, Chelmsford (GB); Waseem Mohammed Anees Qureshi, Chelmsford (GB); Jonathan Pinto, Colchester (GB)

(73) Assignee: BAE Systems PLC, London (GB)

( * ) Notice: Subject to any disclaimer, the term of this patent is extended or adjusted under 35 U.S.C. 154(b) by 136 days.

(21) Appl. No.: 13/511,958

(22) PCT Filed: Nov. 25, 2010

(86) PCT No.: PCT/GB2010/051965

§ 371 (c)(1),
(2), (4) Date: May 24, 2012

(87) PCT Pub. No.: WO2011/064585

PCT Pub. Date: Jun. 3, 2011

(65) Prior Publication Data

US 2012/0235876 A1 Sep. 20, 2012

(30) Foreign Application Priority Data

Nov. 27, 2009 (EP) ..... 09252693
Nov. 27, 2009 (GB) ..... 0920913.1
Nov. 27, 2009 (GB) ..... 0920916.4

(51) Int. Cl.
*H01Q 1/38* (2006.01)
*H01Q 21/06* (2006.01)
*H01Q 9/28* (2006.01)

(52) U.S. Cl.
CPC ..... *H01Q 21/062* (2013.01); *H01Q 9/28* (2013.01); *H01Q 9/285* (2013.01)
USPC ..... 343/700 MS

(58) Field of Classification Search
CPC ... H01Q 21/062; H01Q 21/065; H01Q 9/285; H01Q 1/38
USPC ..... 343/797, 798, 893, 848, 795, 700 MS
See application file for complete search history.

(56) References Cited

U.S. PATENT DOCUMENTS 4,012,741 A 3/1977 Johnson
4,477,813 A 10/1984 Weiss (Continued)

FOREIGN PATENT DOCUMENTS

EP 1 466 386 B1 5/2007
EP 1 978 597 A1 10/2008

(Continued)

OTHER PUBLICATIONS

International Search Report (PCT/ISA/210) issued on Mar. 9, 2011, by the British Patent Office as the International Searching Authority for International Application No. PCT/GB2010/051966.

(Continued)

*Primary Examiner* — Dameon E Levi
*Assistant Examiner* — Hasan Islam
(74) *Attorney, Agent, or Firm* — Maine Cernota & Rardin

(57) ABSTRACT

An antenna assembly is disclosed which includes a layered structure having a planar array of antenna elements; and a feed arrangement perpendicular to the antenna elements; the layered structure further having layers over the planar array of antenna elements with holes provided therethrough to allow the feed arrangement to be connected to contacts for the antenna elements. The layered structure may include vias provided such that heat may be applied remotely to the contacts.

13 Claims, 9 Drawing Sheets

(56) References Cited

U.S. PATENT DOCUMENTS

| | | | | |
|---|---|---|---|---|
| 4,684,952 | A | 8/1987 | Munson et al. | |
| 4,870,424 | A | 9/1989 | Lalezari et al. | |
| 5,220,335 | A | 6/1993 | Huang | |
| 6,028,563 | A * | 2/2000 | Higgins | 343/797 |
| 6,057,802 | A | 5/2000 | Nealy et al. | |
| 6,067,053 | A * | 5/2000 | Runyon et al. | 343/797 |
| 6,441,368 | B1 | 8/2002 | Grinberg et al. | |
| 6,469,671 | B1 | 10/2002 | Pluymers et al. | |
| 6,847,328 | B1 * | 1/2005 | Libonati et al. | 343/700 MS |
| 7,113,142 | B2 | 9/2006 | McCarville et al. | |
| 7,132,995 | B2 | 11/2006 | Gitti | |
| 7,289,063 | B2 * | 10/2007 | Zaghloul | 343/700 MS |
| 7,489,524 | B2 * | 2/2009 | Green et al. | 361/803 |
| 7,764,236 | B2 * | 7/2010 | Hill et al. | 343/702 |
| 2002/0050951 | A1 | 5/2002 | Durham | |
| 2003/0112200 | A1 | 6/2003 | Marino | |
| 2003/0132890 | A1 | 7/2003 | Rawnick et al. | |
| 2004/0007376 | A1 | 1/2004 | Urdahl et al. | |
| 2005/0030231 | A1 * | 2/2005 | Nagaishi et al. | 343/700 MS |
| 2005/0030244 | A1 | 2/2005 | Durham et al. | |
| 2005/0030246 | A1 | 2/2005 | Durham et al. | |
| 2006/0109632 | A1 | 5/2006 | Berlin et al. | |
| 2007/0152882 | A1 | 7/2007 | Hash et al. | |
| 2007/0188398 | A1 * | 8/2007 | Mohuchy et al. | 343/795 |
| 2009/0066601 | A1 | 3/2009 | Eom et al. | |
| 2009/0322642 | A1 * | 12/2009 | Foo | 343/843 |
| 2010/0245202 | A1 * | 9/2010 | Lewis et al. | 343/853 |
| 2010/0277385 | A1 | 11/2010 | Lewis et al. | |

FOREIGN PATENT DOCUMENTS

| | | | |
|---|---|---|---|
| GB | 2 316 233 | A | 2/1998 |
| GB | 2 452 788 | A | 3/2009 |
| JP | 7-106841 | A | 4/1995 |
| JP | 9-055565 | A | 2/1997 |
| JP | 2002-270635 | A | 9/2002 |
| WO | WO 2005/069442 | A1 | 7/2005 |
| WO | WO 2006/099571 | A2 | 9/2006 |
| WO | Wo 2009/047553 | A1 | 4/2009 |
| WO | WO 2009/077791 | A1 | 6/2009 |

OTHER PUBLICATIONS

Search Report issued on Mar. 23, 2010, by the British Patent Office for Application No. 0920916.4.

Search Report issued on May 19, 2010, by the European Patent Office for Application No. 09252693.8.

International Search Report (PCT/ISA/210) issued on Mar. 9, 2011, by the British Patent Office as the International Searching Authority for International Application No. PCT/GB2010/051965.

Search Report issued on Mar. 18, 2010, by the British Patent Office for Application No. 0920913.1.

Search Report issued on Jul. 23, 2010, by the British Patent Office for Application No. 0920913.1.

Notification Concerning Transmittal of International Preliminary Report on Patentability (Forms PCT/IB/326 and PCT/IB/373) and the Written Opinion of the International Searching Authority (Form PCT/ISA/237) issued on Jun. 7, 2012, in corresponding International Application No. PCT/GB2010/051965. (12 pages).

Notification Concerning Transmittal of International Preliminary Report on Patentability (Forms PCT/IB/326 and PCT/IB/373) and the Written Opinion of the International Searching Authority (Form PCT/ISA/237) issued on Jun. 7, 2012, in corresponding International Application No. PCT/GB2010/051966. (8 pages).

* cited by examiner

ANTENNA ARRAY

RELATED APPLICATIONS

This application is a national phase application filed under 35 USC §371 of PCT Application No. PCT/GB2010/051965 with an International filing date of Nov. 25, 2010, which claims priority of GB Patent Application No. 0920913.1, filed Nov. 27, 2009, GB Patent Application 0920916.4, filed Nov. 27, 2009, and European Patent application 09252693.8, filed Nov. 27, 2009. Each of these applications is herein incorporated by reference in their entirety for all purposes.

FIELD OF THE INVENTION

The present invention relates to an antenna array for phased array antennas, and construction thereof.

BACKGROUND

Phased array antennas are used, by vehicles for example, for a wide range of functions including communications, target location and tracking, electronic sensing measure (ESM), electronic counter measures (ECM) and long range all-weather remote sensing. These functions require a range of different frequencies in the microwave and radio frequency bands of the electromagnetic spectrum.

Conventionally, each function is usually performed by one or more dedicated antenna apertures.

A phased array antenna intended to cover a wider range of frequencies and assembled using conventional techniques would face many manufacturing and operational obstacles.

An antenna feed module is described in WO2009/077791 A1.

SUMMARY OF THE INVENTION

In a first aspect, the present invention provides an antenna assembly, comprising: a layered structure comprising a planar array of antenna elements; and a feed arrangement provided in a plane that is at an angle to the plane of the antenna elements; wherein the layered structure further comprises one or more layers over the planar array of antenna elements, and wherein holes are provided through the one or more layers to allow the feed arrangement to be connected to contacts for the planar array of antenna elements.

The feed arrangement may be provided in a plane that is substantially perpendicular to the plane of the antenna elements.

The layered structure may further comprise vias provided such that heat may be applied remotely to the contacts for the array of antenna elements via the vias to connect the contacts electrically to the feed arrangement.

The vias may be adapted for applying heat for soldering.

The antenna assembly may further comprise a fixture securing the planar array of antenna elements and the feed arrangement, wherein the fixture comprises a ground plane box comprising a ground plane and sides.

The ground plane may comprise grooves for positioning therein parts of the feed arrangement.

The ground plane may comprise holes for parts of the feed arrangement to pass through.

The ground plane box may be made of aluminium.

The ground plane and the planar array of antenna elements may be separated by a distance approximately equal to one tenth of the wavelength of the intended lowest frequency of operation.

The ground plane and the planar array of antenna elements may be separated by a distance approximately equal to 11.7 mm.

The antenna assembly may further comprise electrical connector blocks connected to parts of the feed arrangement, the electrical connector blocks providing transmission connection into and/or away from the antenna assembly and the electrical connector blocks further providing mechanical fixing of the parts of feed arrangement relative to the ground plane box.

The connector blocks may comprise apertures for connections that are positioned offset relative to each other.

The feed arrangement may comprise one or more multilayer printed circuit boards.

One or more baluns may be integrated in the feed arrangement.

In a further aspect, the present invention provides an antenna assembly, comprising: a planar array of antenna elements; and vias provided such that heat may be applied remotely to contacts for the array of antenna elements via the vias to connect the contacts electrically to a feed arrangement.

In a further aspect, the present invention provides an antenna assembly, comprising: a planar array of antenna elements; and a ground plane box comprising a ground plane and sides.

The antenna assembly may further comprise a feed arrangement and electrical connector blocks connected to parts of the feed arrangement, the electrical connector blocks providing transmission connection into and/or away from the antenna assembly and the electrical connector blocks further providing mechanical fixing of the parts of feed arrangement relative to the ground plane box.

In a further aspect, the present invention provides an antenna assembly, comprising: a planar array of antenna elements; and a ground plane separated from the planar array of antenna elements by a distance approximately equal to one tenth of the wavelength of the intended lowest frequency of operation.

The ground plane and the planar array of antenna elements may be separated by a distance approximately equal to 11.7 mm.

In any of the above aspects, the antenna elements may be substantially approximately triangular shaped, such that a point of a triangle of a first pole of a dipole is adjacent a point of the triangle of a second pole of the same dipole, whereas the side of the triangle of the first pole opposite the point of the triangle of the first pole provides an edge that is adjacent to a side of a triangle of a pole of a different dipole.

DETAILED DESCRIPTION

Figure 1:
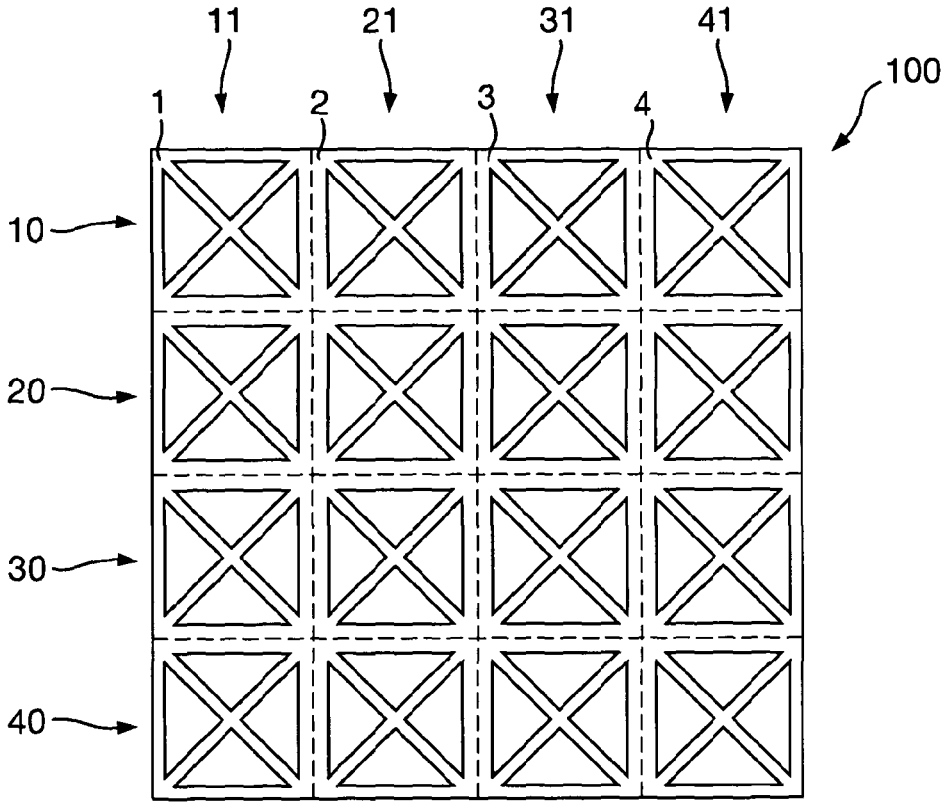
FIG. 1 is a schematic illustration of a plan view of a dipole array which is used to form a multi-octave phased array aperture.

FIG. 1 is a schematic illustration of a plan view of a dipole array 100 which is used in an active electronically scanned array (AESA) antenna.

In this embodiment, the dipole array 100 is formed by photolithographically patterning a copper layer that is attached to a Liquid Crystal Polymer (LCP) layer.

In this embodiment, each dipole element comprises four substantially triangular shaped elements patterned on to a top surface of the dipole array 1. The dipole elements will be described in more detail later below with reference to FIG. 2.

In this embodiment, the dipole array 100 comprises sixteen dipole elements arranged in a four rows by four column grid. The four rows are hereinafter referred to as the first row 10, the second row 20, the third row 30, and the fourth row 40. The four columns are hereinafter referred to the first column 11, the second column 21, the third column 31, and the fourth column 41.

The structure of the dipole array 100 will be described with reference to the four dipole elements in the first row 10. These four elements are hereinafter referred to as the first dipole element 1, the second dipole element 2, the third dipole element 3, and the fourth dipole element 4.

The first dipole element 1 is in the first row 10 and the first column 11. The second dipole element 2 is in the first row 10 and the second column 21. The third dipole element 3 is in the first row 10 and the third column 31. The fourth dipole element 4 is in the first row 10 and the fourth column 41.

Figure 2:
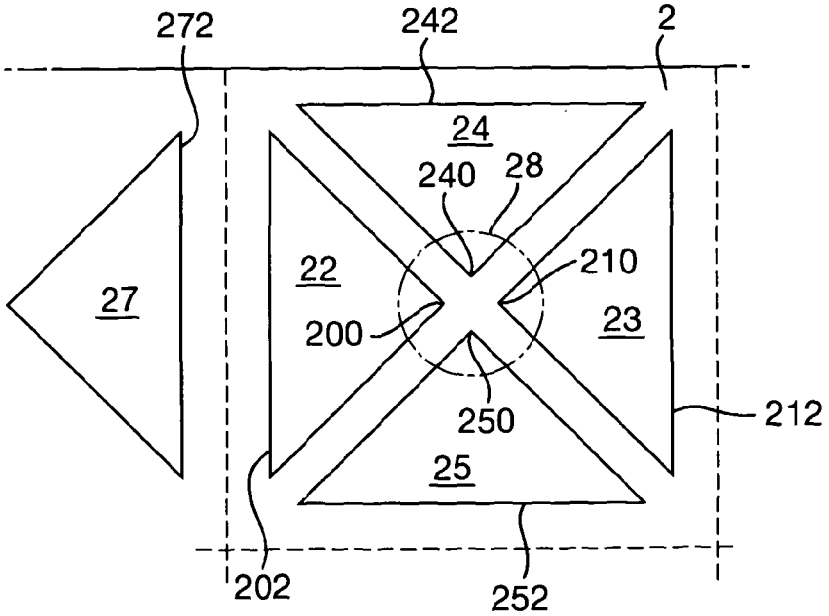
FIG. 2 is a schematic illustration of a plan view of a second dipole element and a certain portion of a first dipole element that is directly adjacent to the second dipole element.

FIG. 2 is a schematic illustration of a plan view of the second dipole element 2 and a certain portion of the first dipole element 1 that is directly adjacent to the second dipole element 2.

The second dipole element 2 comprises a horizontally polarised dipole and a vertically polarised dipole.

The horizontally polarised dipole comprises a first and a second pole, hereinafter referred to as the "first horizontal pole 22" and the "second horizontal pole 23" respectively.

In this embodiment, the first horizontal pole 22 and the second horizontal pole 23 are each substantially triangular in shape. The first horizontal pole 22 and the second horizontal pole 23 are positioned substantially opposite each other such that they form a 'bow-tie' shape, each triangular pole 22, 23 having a vertex at the middle of the bow-tie shape, said vertices being proximate to the centre of the second dipole element 2.

The vertex of the first horizontal pole 22 proximate to the centre of the second dipole element 2, is hereinafter referred to as the "first vertex", and is indicated in FIG. 2 by the reference numeral 200. The edge of the first horizontal pole 22 that does not form the first vertex 200, i.e. the edge of the first horizontal pole 22 which is the furthest edge of the first horizontal pole 22 from the centre of the second dipole element 2, is hereinafter referred to as the "first outside edge" and is indicated in FIG. 2 by the reference numeral 202.

The vertex of the second horizontal pole 23 proximate to the centre of the second dipole element 2, is hereinafter referred to as the "second vertex", and is indicated in FIG. 2 by the reference numeral 210. The edge of the second horizontal pole 23 that does not form the second vertex 210, i.e. the edge of the second horizontal pole 23 which is the furthest edge of the second horizontal pole 23 from the centre of the second dipole element 2, is hereinafter referred to as the "second outside edge" and is indicated in FIG. 2 by the reference numeral 212.

In this embodiment, the first outside edge 202 is 4.8 mm long. In this embodiment, the second outside edge 212 is 4.8 mm long. Also, the first and second outside edges 202, 212 are substantially parallel.

In this embodiment, the first vertex 200 and the second vertex 210 are separated by a distance of 0.4 mm.

The vertically polarised dipole comprises a first and a second pole, hereinafter referred to as the "first vertical pole 24" and the "second vertical pole 25" respectively.

In this embodiment, the first vertical pole 24 and the second vertical pole 25 are each substantially triangular in shape. The first vertical pole 24 and the second vertical pole 25 are positioned substantially opposite each other such that they form a 'bow-tie' shape, each triangular pole 24, 25 having a vertex at the middle of the bow-tie shape, said vertices being proximate to the centre of the second dipole element 2.

The vertex of the first vertical pole 24 proximate to the centre of the second dipole element 2, is hereinafter referred to as the "third vertex", and is indicated in FIG. 2 by the reference numeral 240. The edge of the first vertical pole 24 that does not form the third vertex 240, i.e. the edge of the first vertical pole 24 which is the furthest edge of the first vertical pole 24 from the centre of the second dipole element 2, is hereinafter referred to as the "third outside edge" and is indicated in FIG. 2 by the reference numeral 242.

The vertex of the second vertical pole 25 proximate to the centre of the second dipole element 2, is hereinafter referred to as the "fourth vertex", and is indicated in FIG. 2 by the reference numeral 250. The edge of the second vertical pole 25 that does not form the fourth vertex 250, i.e. the edge of the second vertical pole 25 which is the furthest edge of the second vertical pole 25 from the centre of the second dipole element 2, is hereinafter referred to as the "fourth outside edge" and is indicated in FIG. 2 by the reference numeral 252.

In this embodiment, the third outside edge 242 is 4.8 mm long. In this embodiment, the fourth outside edge 252 is 4.8 mm long. Also, the third and fourth outside edges 242, 252 are substantially parallel. Moreover, the third and fourth outside edges 242, 252 are substantially perpendicular to the first and second outside edges 202, 212.

In this embodiment, the third vertex 240 and the fourth vertex 250 are separated by a distance of 0.4 mm.

Figure 3:
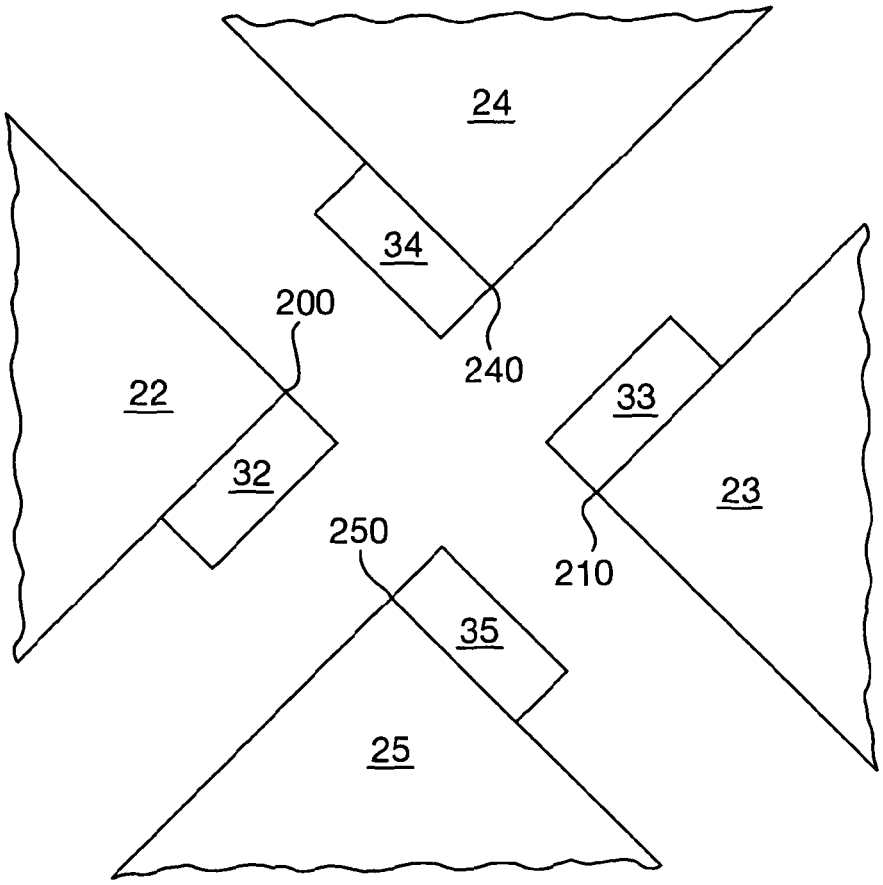
FIG. 3 shows in a magnified schematic (not to scale) form an area of FIG. 2.

Each of the poles 22, 23, 24, 25 has a respective contact pad, which will now be described in more detail with reference to FIG. 3. FIG. 3 shows in a magnified schematic (not to scale) form the area of FIG. 2 indicated by reference numeral 28, i.e. the vertexes of the poles. As such, in FIG. 3, only the end portions of the poles 22, 23, 24, 25 are shown.

The first horizontal pole 22 comprises a contact pad, hereinafter referred to as the "first contact 32", via which the first horizontal pole 22 is supplied with a signal, or forwards a received signal, as described in more detail later below. The first contact 32 is positioned adjacent, or substantially near to, the first vertex 200.

The second horizontal pole 23 comprises a contact pad, hereinafter referred to as the "second contact 33", via which the second horizontal pole 23 is supplied with a signal, or forwards a received signal, as described in more detail later below. The second contact 33 is positioned adjacent, or substantially near to, the second vertex 210, and is in contact with the second horizontal pole 23.

The first vertical pole 24 comprises a contact pad, hereinafter referred to as the "third contact 34", via which the first vertical pole 24 is supplied with a signal, or forwards a received signal, as described in more detail later below. The third contact 34 is positioned adjacent, or substantially near to, the third vertex 240, and is in contact with the first vertical pole 24.

The second vertical pole 25 comprises a contact pad, hereinafter referred to as the "fourth contact 35", via which the second vertical pole 25 is supplied with a signal, or forwards a received signal, as described in more detail later below. The fourth contact 35 is positioned adjacent, or substantially near to, the fourth vertex 250, and is in contact with the second vertical pole 25.

For each of the above described contacts, the contact and the pole are respective joined up areas of the patterned copper layer.

Thus, the second dipole element 2 comprises four contacts 32, 33, 34, 35 substantially near the middle of the second dipole element 2.

Each of the other dipole elements in the dipole array 100, for example the first dipole element 1, the third dipole element 3, and the fourth dipole element 4, comprise horizontal and vertical dipoles, comprising poles and contacts corresponding to those described above for the second dipole element 2.

FIG. 2 further shows a pole of the horizontal dipole of the first dipole element. This pole, hereinafter referred to as the "third horizontal pole 27", corresponds to the second horizontal pole 23 of the second dipole element 2. Similarly to the second horizontal pole 23, the third horizontal pole comprises an outside edge, hereinafter referred to as the "fifth outside edge 272", and, in the vicinity of the vertex, a contact, hereinafter referred to as the "fifth contact" (not shown).

The first horizontal pole 22 is adjacent to the third horizontal pole 27. The first horizontal pole 22 and the third horizontal pole 27 are positioned such that the first outside edge 202 and the fifth outside edge 272 are substantially parallel. Also, in this embodiment the first horizontal pole 22 and the third horizontal pole 27 are positioned such that the first horizontal pole 22 and the third horizontal pole 27 are 0.4 mm apart. In other words, first outside edge 202 and the fifth outside edge 272 are 0.4 mm apart.

The relatively small separation between the first horizontal pole 22 and the third horizontal pole 27, i.e. the relatively small separation between the first outside edge 202 and the fifth outside edge 272, and the relatively large size of the first horizontal pole 22 and the third horizontal pole 27 at the first outside edge 202 and the fifth outside edge 272 respectively, advantageously tend to provide that the horizontal diode of the first dipole element 1 and the horizontal diode of the second dipole element 2 are highly coupled. In other words, the relatively small spacing between the horizontal dipoles of the first and second dipole elements 1, 2, together with the relatively large sizes of the surfaces of the horizontal dipoles of the first and second dipole elements 1, 2 that are directly adjacent, tend to provide for a relatively large capacitance between the horizontal dipoles of the first and second dipole elements 1, 2.

In a corresponding way to the way that the horizontal dipoles of the first and second dipole elements 1, 2, are highly coupled together (as described above), each horizontal dipole of each element is highly coupled to the horizontal dipole of the element that is horizontally and directly adjacent to it. For example, in the first row 10 of the dipole array 100 the horizontal dipole of the first element 1 is highly coupled to the horizontal dipole of the second element 2. Also, the horizontal dipole of the second element 2 is highly coupled to both the horizontal dipole of the first element 1 and the horizontal dipole of the third element 3. Also, the horizontal dipole of the third element 3 is highly coupled to both the horizontal dipole of the second element 2 and the horizontal dipole of the fourth element 4. Also, the horizontal dipole of the fourth element 4 is highly coupled to the horizontal dipole of the third element 3.

Furthermore, in a corresponding way to the way that the horizontal dipoles of the first and second dipole elements 1, 2, are highly coupled together (as described above), each vertical dipole of each element is highly coupled to the vertical dipole of the element that is vertically and directly adjacent to it. For example, in the first column 11 of the dipole array 100 the vertical dipole of the first element 1 is highly coupled to the vertical dipole of the dipole element in the second row 20 and first column 10. Also, the vertical dipole of the dipole element in the second row 20 and first column 10 is highly coupled to both the vertical dipole of the first element 1 and the vertical dipole of the dipole element in the third row 30 and first column 11. Also, the vertical dipole of the dipole element in the third row 30 and first column 11 is highly coupled to both the vertical dipole of the dipole element in the second row 20 and first column 11 and the vertical dipole of the dipole element in the fourth row 40 and first column 11. Also, the vertical dipole of the dipole element in the fourth row 40 and first column 11 is highly coupled to the vertical dipole of the dipole element in the third row 30 and first column 11.

Furthermore, due to the above described arrangement, advantageously some coupling tends to occur between elements in the array that are not the nearest neighbours, i.e. coupling tends to occur between all dipole elements in the array.

Thus, the dipole array 100 may be considered as comprising highly coupled dipoles.

Moreover, by virtue of the substantially orthogonal nature of the relative positioning/alignment of each vertical dipole with its corresponding horizontal dipole (e.g. the orthogonal positional relationship between the vertical dipole comprising the first vertical pole 24 and the second vertical pole 25 and the horizontal dipole comprising the first horizontal pole 22 and the second horizontal pole 23), independent dual polarisation operation is provided, i.e. the two polarisations (vertical and horizontal) may be operated independently. This advantageously allows, for example, the two polarisations to be driven with different phases. The overall substantially triangular form of the individual poles, with the triangles fitted in the above described interlaced manner, advantageously allows such substantial orthogonal positional relationship to be achieved whilst also achieving the high coupling effects described above.

It will be appreciated that the above described substantially triangular shaped form of the individual poles provides a preferred layout in which the adjacent edges of adjacent poles where the adjacent poles are from different respective nearest neighbour dipole elements (e.g. the first edge 202 which is adjacent to the fifth edge 272 where these two edges are from neighbouring dipole elements, i.e. the pole whose distal edge is edge 202 forms a dipole with the pole whose distal edge is edge 212, not with the pole with the adjacent edge 272) have a small separation between them compared to the dimensions of the poles and are of relatively large lengths compared to the dimensions of the poles such as to give highly couple dipoles as described above. As such it will be appreciated that, although true triangular shape represents a preferred implementation, nevertheless the substantially triangular shape may vary from absolute triangular shape in a variety of ways whilst still achieving some or all of the above described advantageous effects. For example, the overall shape of a pole may appear as an absolute triangle, but with the three sides thereof in detail being or comprising jagged, partly curved or some other deviations from straight. Another possibility is that the overall shape may be only approximately triangular, e.g. assessed as more like a triangle than any other simple geometric shape, even though not truly a triangle. Thus it will be appreciated that in other embodiments any substantially approximately triangular shaped poles may be provided. More generally, in other embodiments, yet further shapes may be provided that provide some or all of the advantageous effects provided by the above described substantially approximate triangular shaped poles. For example, irregular or more interlaced shapes may be provided, as long as such shapes provide a form of interlacing or relative positioning between the four separate poles of a given dipole pair such that a high degree of coupling is achieved between neighbouring dipoles by respective adjacent distal edges from neighbouring poles that are from respective neighbouring dipoles) being relatively long and relatively close to each other compared to the dimensions of the poles.

Figure 4:
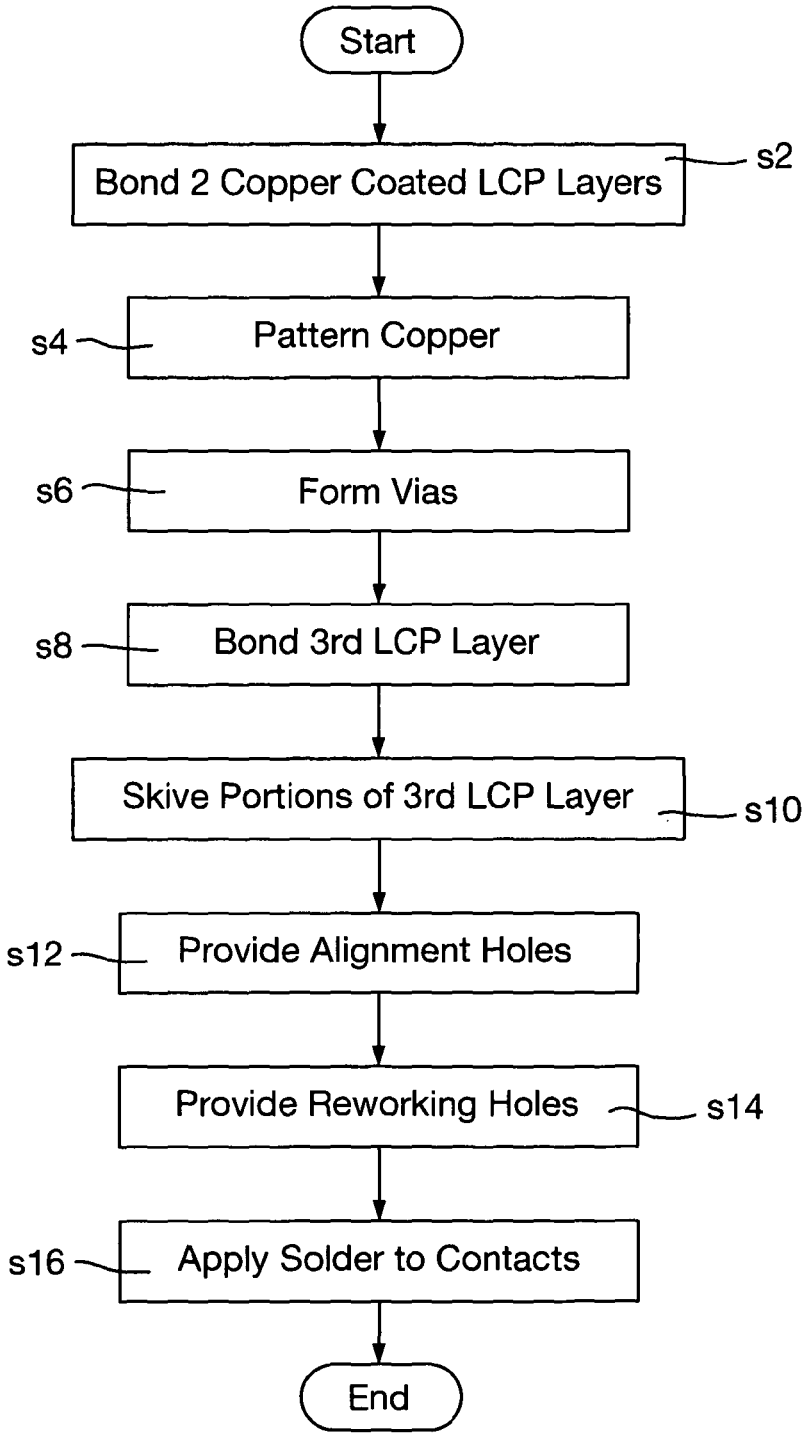
FIG. 4 is a process flow chart of an example method of fabrication for fabricating the dipole array.

FIG. 4 is a process flow chart of an example method of fabrication for fabricating the dipole array 100.

At step s2, two copper coated Liquid Crystal Polymer (LCP) layers are bonded together such that a copper film is on each of the outer surfaces of the bonded structure.

Figure 5:
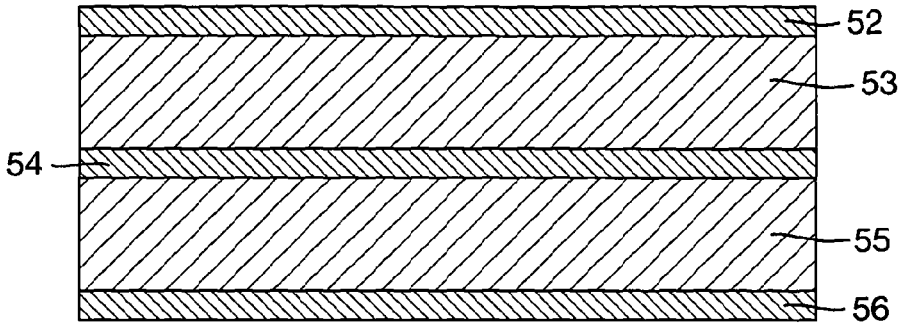
FIG. 5 is a schematic illustration of the assembly produced by performing step s2 of the method of fabrication.

FIG. 5 is a schematic illustration of the assembly produced by performing step s2. The material stack comprises a first copper film 52, a first LCP layer 53, a first bond layer 54, a second LCP layer 55, and a second copper film 56. In this embodiment, each LCP layer and copper film is provided in the form of 50 μm thick Rogers Corporation Ultralam™ 3850 LCP, originally with 0.5 oz/sq.ft (17.5 μm) copper cladding on both faces but which then has the copper removed from one of its faces. In this embodiment, the first bond layer 54 is made from Ultralam™ 3908 bonding film. (In other embodiments, a single layer of LCP with the copper left on both faces may be used instead of the bonded stack shown in FIG. 5, if such a single layer of LCP is of sufficient thickness for a particular implementation.)

Figure 6:
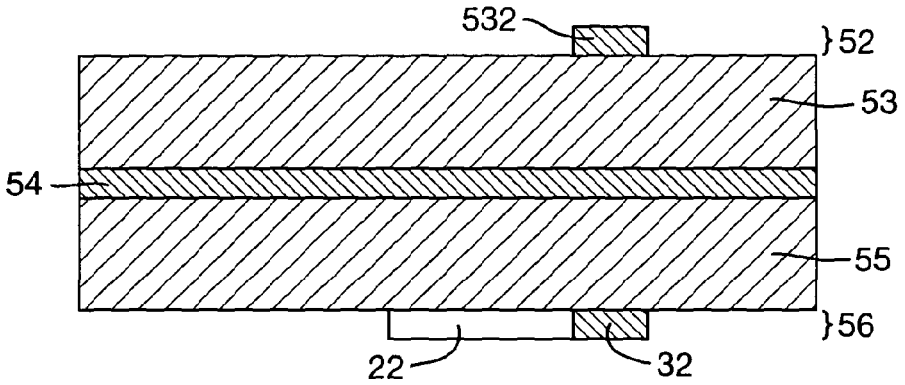
FIG. 6 is a schematic illustration of the assembly produced by performing steps s2-s4 of the method of fabrication.

At step s4, the first and second copper films 52, 56 are photolithographically patterned to remove portions of the first and second copper films 52, 56. The first copper film 52, on completion, contains pads, hereinafter referred to for convenience as "thermal pads", which are later used to apply heat which is then conducted to the lower layer through 'via' structures subsequently described, to the lower second copper film layer 56. The thermal pads are provided in the first copper film pattern such as to correspond to the earlier described contact pads provided in the second copper film 56. The second copper film 56 is patterned to form the above described dipole element parts and contact pads, such as the poles 22, 23, 24, 25 and the contact pads 32, 33, 34, 35. FIG. 6 is a schematic illustration of the assembly produced by performing steps s2-s4. By way of example, in FIG. 6, as part of the remaining patterned second copper film 56, a part of the first horizontal pole 22 and the first contact 32 are shown schematically (not to scale) in cross-section. Furthermore, in FIG. 6, as part of the remaining patterned first copper film 52, a part of a corresponding thermal pad 532 is shown schematically (not to scale) in cross-section.

At step s6, vias are formed. Holes are drilled through the assembly at points on a surface of the assembly corresponding to the positions of the contacts, for example the first, second, third and fourth contacts 32, 33, 34, 35 and the fifth contact, such as to also pass through the corresponding thermal pads such as thermal pad 532. These holes are plated with copper to produce through-vias, which thus thermally couple a respective contact with its corresponding thermal pad. These vias are advantageous in a process of assembling an antenna from the dipole array 100 for reasons described later below with reference to FIG. 14.

Figure 7:
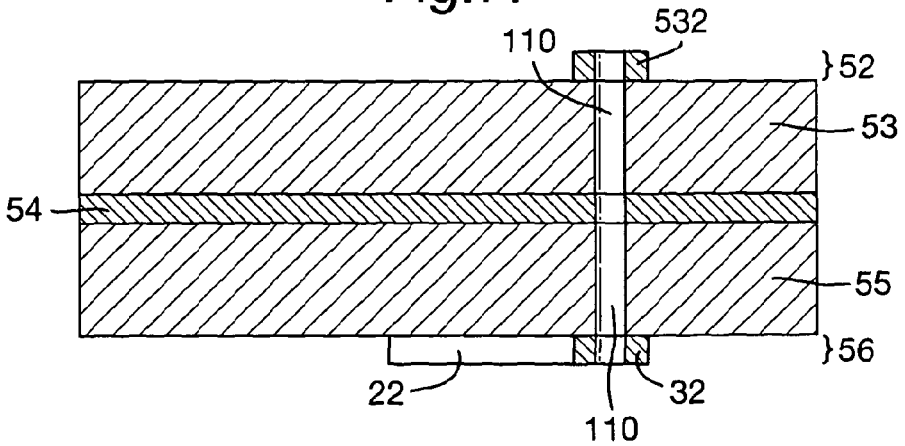
FIG. 7 is a schematic illustration of the assembly produced by performing steps s2-s6 of the method of fabrication.
Figure 8:
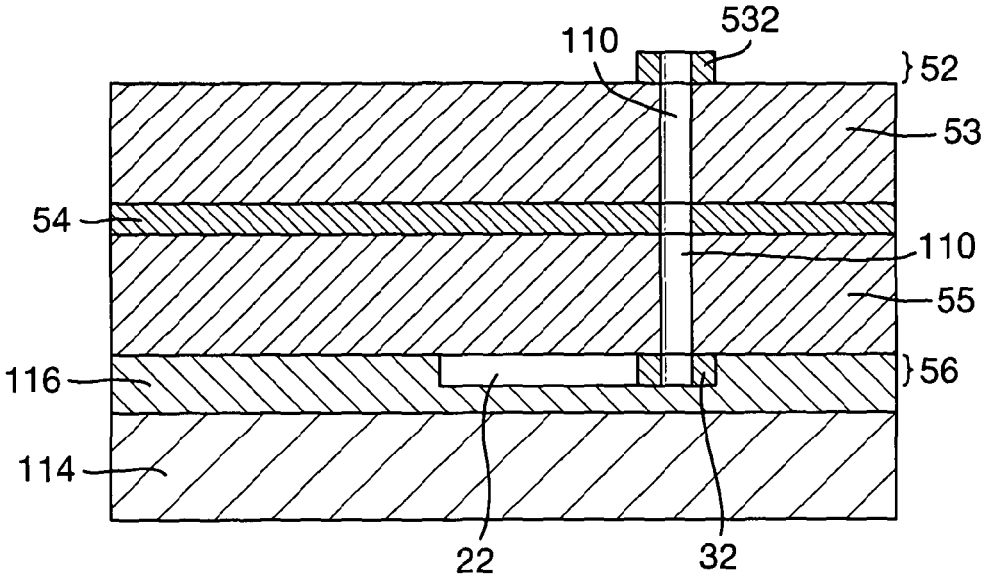
FIG. 8 is a schematic illustration of the assembly produced by performing steps s2-s8 of the method of fabrication.

FIG. 7 is a schematic illustration of the assembly produced by performing steps s2-s6. In addition to those elements shown in FIGS. 5 and 6, FIG. 8 shows an example of the vias, namely a via 110. The via 110 is positioned to pass through the contact 32 and the thermal pad 532, thereby thermally coupling the contact 32 and the thermal pad 532.

At step s8, a third LCP layer is bonded to the exposed bottom surface of the second LCP layer 55/the remaining patterned parts of second copper film 56.

FIG. 8 is a schematic illustration of the assembly produced by performing steps s2-s8, further showing the third LCP layer 114 bonded to the second LCP layer 55/the remaining patterned parts of second copper film 56 by a second bond layer 116. In this embodiment, the second bond layer 116 is Ultralam™ 3908 bonding film.

At step s10, portions of the third LCP layer 114 and the second bond layer 116 are removed, or skived, to expose the contacts, such as the contacts 32, 33, 34, 35. In this embodiment, this removal, or skiving, is performed using laser ablation.

Figure 9:
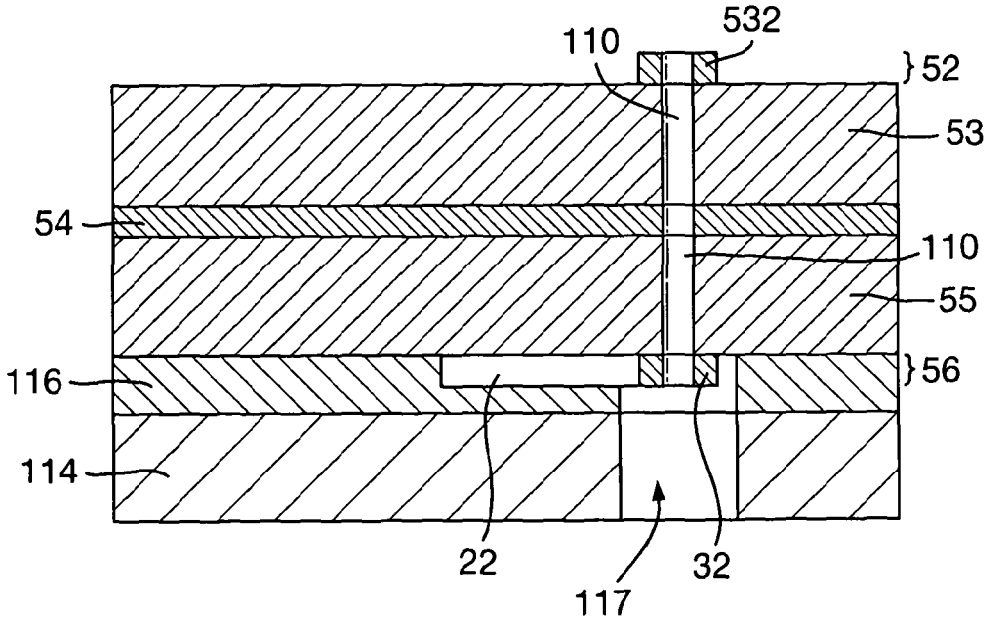
FIG. 9 is a schematic illustration of the assembly produced by performing steps s2-s10 of the method of fabrication.

FIG. 9 is a schematic illustration of the assembly produced by performing steps s2-s10. FIG. 9 shows, by way of example, a skived region 117 which has exposed the contact 32.

The exposed contacts such as contact 32 are then preferably plated with gold for corrosion protection purposes.

At step s12, alignment holes (not shown) are then provided by drilling though the whole assembly. Such alignment holes are provided away from any functional areas, and are used for later alignment of the whole assembly of FIG. 9 to other parts of the array. Such alignment holes are not essential, and other alignment techniques may be used instead.

At step s14, further holes are provided through the whole assembly. In this embodiment such holes will be used for reworking purposes after a main soldering step, and as such may be conveniently termed reworking holes. However, the term reworking is not limiting, and in other embodiments some or all of these holes may be used for a main soldering process, or for particular first steps of soldering particular contacts with others of the contacts soldered by different means. More generally, if other soldering processes are adequate such that reworking is not envisaged or required, then these reworking holes may instead be omitted. The reworking holes are provided in the vicinity of the contacts such as the contacts 32, 33, 34, 35. The holes are preferably shaped so that they are as close as possible to the contacts, but do not remove any of the copper film forming the contact or any of the copper film forming the poles, such as the poles 22, 23, 24, 25. Preferably the reworking holes are provided of a shape that enables one reworking hole to provide access to all four of the contacts of a given dipole element.

Figure 10:
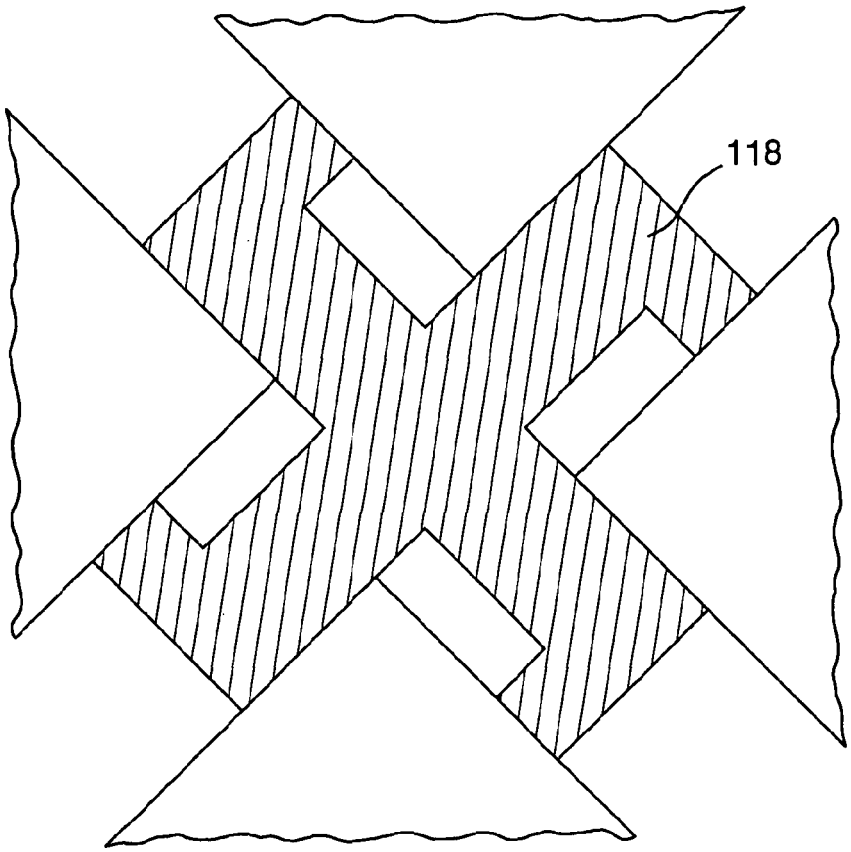
FIG. 10 shows schematically a shape of a reworking hole.

FIG. 10 shows one such shaped reworking hole 118, shown schematically (not to scale) and of approximate shape as a shaded area 118 around the components previously shown in, and described with reference to, FIG. 3. The shape may conveniently be termed substantially swastika-like.

Figure 11:
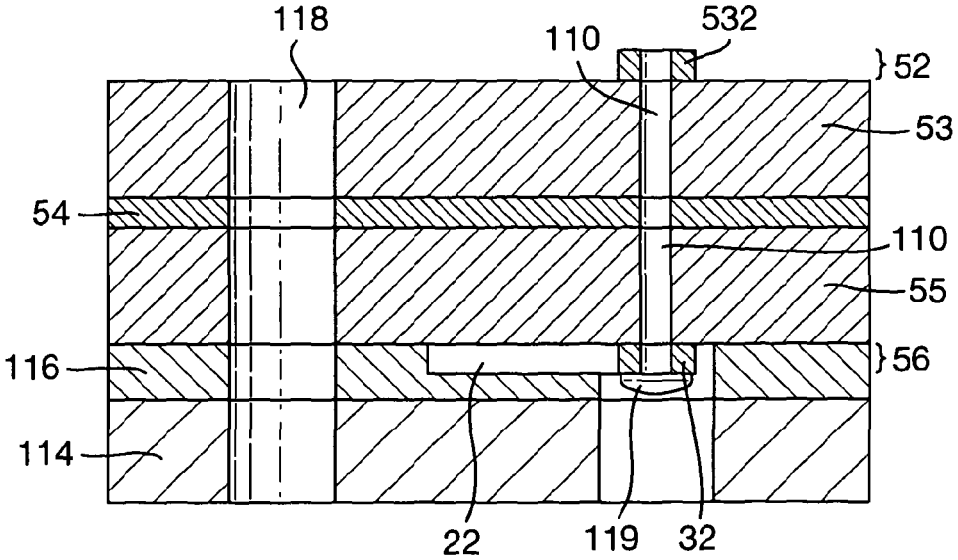
FIG. 11 is a schematic illustration of the assembly produced by performing steps s2-s16 of the method of fabrication.

FIG. 11 shows schematically (not to scale), a part of the cross-section of the reworking hole in the context of the cross-sectional representation of the assembly. It is noted that in FIG. 11 the reworking hole is merely shown at a nominal position to enable the figure to indicate the hole in principle for improved understanding, and that its position as shown may not necessarily be consistent with regard to the true shape or location of the reworking hole compared to the contact and pole.

At step s16, solder is applied to the contacts such as the contacts 32, 33, 34, 35. By way of example, in FIG. 11 a solder wetting 119 is shown applied to the exposed contact 32. However, it is not essential to apply this solder at this time, and in other embodiments the solder may be applied at a later stage, or even not at all, since for example in other embodiments solder may instead be applied to the element that the contact 32 is to be soldered to, or in yet further embodiments other techniques, e.g. thermal adhesives, may be used instead if soldering. In the latter case, thermal adhesive may be applied to the contacts such as contact 32 at step s16, or may be applied at another stage.

Thus, an example method of fabricating the dipole array 100 is provided.

The dipole array 100 forms an antenna suitable for transmitting and/or receiving signals. Signals to be transmitted (or signals received by) the antenna are sent from (or to) an array of transmit-receive modules via a feed structure incorporating integrated baluns in order to achieve broad impedance matching of the elements with the transmission line fed inputs. The horizontal and vertical dipoles in the dipole elements of the dipole array 100 are connected to the feed structure via the contacts such as the contacts 32, 33, 34, 35 that are substantially in the middle of each of the dipole elements, as described above with reference to FIG. 2. The feed structure will be described below with reference to FIG. 12.

The dipole array 100 tends to be capable of functioning at a range of different frequencies in the microwave and radio frequency bands of the electromagnetic spectrum. These performance characteristics tend to provide that a number of functions may be performed by the dipole array 100. Thus, reductions in weight, cost and size of an antenna comprising such a dipole array 100 tend to result.

Figure 12:
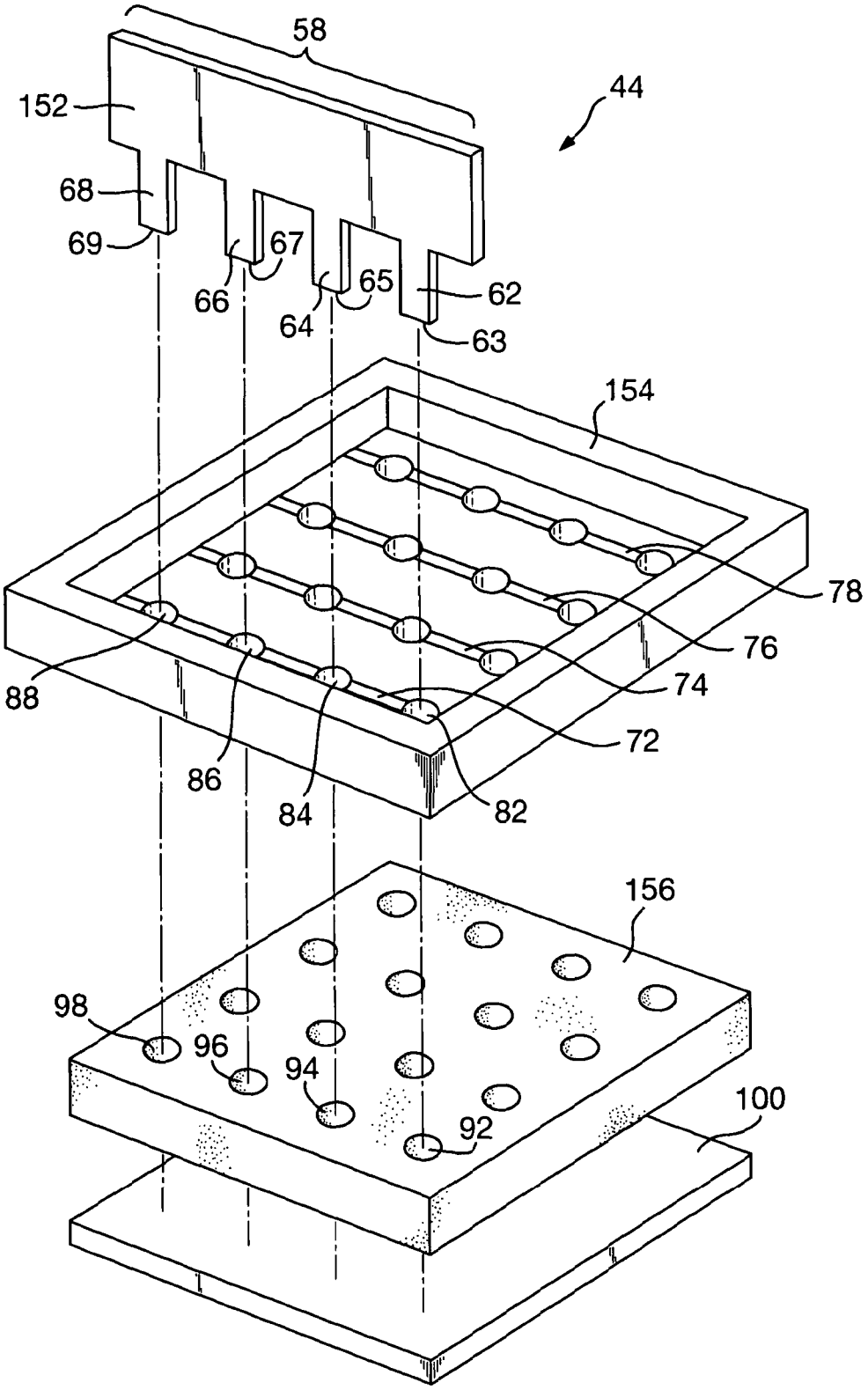
FIG. 12 is a schematic illustration of an exploded view of a feed structure via which signals are sent between the dipole array and transmit-receive module.

FIG. 12 is a schematic illustration (not to scale) of an exploded view of the feed structure 44 via which signals are sent between the dipole array 100 and the antenna input/output via integrated baluns. The feed network is not shown in FIG. 12. Connection of the dipole array 100 to the feed will be described later below with reference to FIG. 13.

In this embodiment, the feed structure 44 comprises four pillar boards. For clarity and ease of understanding on one such pillar board is depicted in FIG. 12. This pillar board is indicated by the reference numeral 152 and will hereinafter be referred to as the "first pillar board". The feed structure 144 further comprises a ground plane box 154, and a foam layer 156.

The purpose of each respective pillar board is to connect the antenna inputs, via integrated baluns (not shown in FIG. 12) to the four contacts of each of the four dipole elements in a respective row of the dipole array 100. How a pillar board makes contact with the four contacts of a dipole element is described later below with reference to FIG. 13 after the description of the shapes and configuration of the pillar boards, the ground plane box 154, and the foam layer 156.

The first pillar board 152 is connected to transmit-receive modules (not shown) via a connection arrangement 58 that is indicated merely conceptually in FIG. 12. Any suitable connection arrangement may be employed. The particular connection arrangement 58 employed in this embodiment will be described in more detail later below with reference to FIG. 14.

The shape of the first pillar board 152 is a block having four protrusions (which may also be termed pillars), hereinafter referred to as the "first protrusion 62", the "second protrusion 64", the "third protrusion 66", and "the fourth protrusion 68".

Each respective protrusion has a free end, or tip. The tip of the first protrusion will hereinafter be referred to as the "first tip 63". The tip of the second protrusion will hereinafter be referred to as the "second tip 65". The tip of the third protrusion will hereinafter be referred to as the "third tip 67". The tip of the fourth protrusion will hereinafter be referred to as the "fourth tip 69".

Each respective protrusion is positioned through a respective hole in the ground plane box 154 and through a respective hole in the foam layer 156 such that the respective tip makes contact with the four contacts of a respective pair of dipole elements (one in each of two polarisations), as described in more detail below with reference to FIG. 13.

The ground plane box 154 is an open-topped, substantially square, box made of aluminium. In this embodiment, the ground plane box 154 is fabricated by machining a single ingot of aluminium.

The ground plane box 154 comprises four grooves, hereinafter referred to as the "first groove 72", the "second groove 74", the "third groove 76", and "the fourth groove 78". Each respective groove is adapted to hold in place a respective pillar board. For example, the first groove 72 is adapted to house the first pillar board 152.

The ground plane box 154 further comprises sixteen holes through a bottom surface of the ground plane box 154. Four holes are positioned in each of the four grooves 72, 74, 76, 78. The four holes through the ground plane box 154 on the first groove 72 are hereinafter referred to as the "first ground plane hole 82", the "second ground plane hole 84", the "third ground plane hole 86", and the "fourth ground plane hole 88".

The ground plane box 154 advantageously tends to provide dimensional stability to the overall arrangement, thereby providing dimensional stability to the dipole elements, which tends to improve their operation in terms of correct phase and so on. Moreover, the grooves in ground plane box 154 advantageously provide a reduced thickness at the locations where the protrusions of the pillar board are, which tends to provide a first advantage in that the protrusion length may be reduced and/or a second advantage that the height of the overall assembly may be reduced. Moreover, by providing the grooves only where required (e.g. compared to making the whole bottom part of the ground box thinner) these advantages tend to be obtained whilst maintaining a substantial part of the physical strength of the ground box, and hence its ability to provide the above described dimensional stability etc. The ground plane box further allows the pillar bards, in particular the protrusions, to be held perpendicular to the dipole elements.

The foam layer 156 is a layer of foam of substantially uniform thickness. In this embodiment, the foam layer 156 is approximately 11.7 mm thick.

In this embodiment, the foam layer comprises sixteen holes arranged such that when the ground plane box 154 is positioned on top of the layer of foam layer 156, the sixteen holes in ground plane box 154 align with the sixteen holes in the foam layer 156. In other words, the holes in the foam layer are arranged in the four rows of four holes and are spaced substantially the same way as the holes in the ground plane box 154. In this embodiment, a row of holes in the foam layer 156 comprises a first foam layer hole 92, a second foam layer hole 94, a third foam layer hole 96, and a fourth foam layer hole 98. When the ground plane box 154 is positioned on top of the foam layer 156, the first ground plane hole 82 is aligned with the first foam layer hole 92, the second ground plane hole 84 is aligned with the second foam layer hole 94, the third ground plane hole 86 is aligned with the third foam layer hole 96, and the fourth ground plane hole 88 is aligned with the fourth foam layer hole 98.

In this embodiment, the first pillar board 152, the ground plane box 154 and the foam layer 156 are positioned relative to each other such that the first pillar board 152 lies along the first groove 72 in the ground plane box 154. Also, the first protrusion 62 passes through the first ground plane hole 82 and the first foam layer hole 92 such that the first tip 63 makes contact with the four contacts of the first dipole element 1. Also, the second protrusion 64 passes through the second ground plane hole 84 and the second foam layer hole 94 such that the second tip 65 makes contact with the four contacts of the second dipole element 2. Also, the third protrusion 66 passes through the third ground plane hole 86 and the third foam layer hole 96 such that the third tip 67 makes contact with the four contacts of the third dipole element 3. Also, the fourth protrusion 68 passes through the fourth ground plane hole 88 and the fourth foam layer hole 98 such that the fourth tip 69 makes contact with the four contacts of the fourth dipole element 4.

Similarly, a second pillar board (not shown) comprising four protrusions, and connected to the transmit-receive modules by a corresponding microwave connector, is positioned along the second groove 74 such that the respective protrusions of the pillar board pass through holes in the ground plane box 154 and the foam layer 156 to contact the four contacts on a respective different dipole element on the second row 20.

Similarly, a third pillar board (not shown) comprising four protrusions, and connected to the transmit-receive modules by a corresponding microwave connector, is positioned along the third groove 76 such that the respective protrusions of the pillar board pass through holes in the ground plane box 154 and the foam layer 156 to contact the four contacts on a respective different dipole element on the third row 30.

Similarly, a fourth pillar board (not shown) comprising four protrusions, and connected to the transmit-receive modules by a corresponding microwave connector, is positioned along the fourth groove 78 such that the respective protrusions of the pillar board pass through holes in the ground plane box 154 and the foam layer 156 to contact the four contacts on a respective different dipole element on the fourth row 40.

How a pillar board makes contact with the four contacts of a dipole element (i.e. a pair of dipoles) will now be described by way of example with reference to the second tip 65 and the second dipole element 2 described above with reference to FIG. 2.

Figure 13:
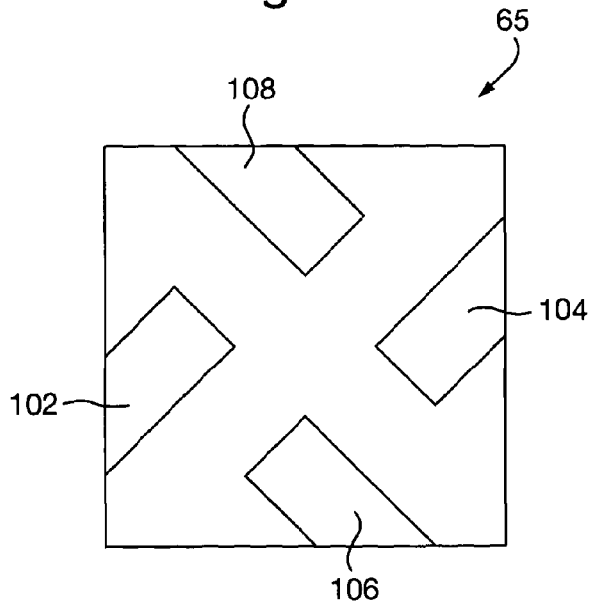
FIG. 13 is a schematic illustration of a bottom view of the tip of a second protrusion of a pillar board.

FIG. 13 is a schematic illustration of a bottom view of the second tip 65.

The second tip 65 is approximately a 3 mm square situated at the end of the second protrusion 64. The second tip 65 comprises electrical contact pads, hereinafter referred to as the "first pad 102", the "second pad 104", the "third pad 106", and the fourth pad 108".

In this embodiment, the pads are formed from first plating an outer surface of the first pillar board 152, then laser stencilling the second tip 65 to the required pattern, and then peeling off the excess metallisation with a scalpel blade. Each pad is substantially rectangular having a width of approximately 0.5 mm, and a length of approximately 1.25 mm.

During assembly, the protrusions are inserted through the holes in the ground plane box 54 and the foam layer 56 and positioned in the skived regions, such as the skived region 117, in the dipole array 100. For example, the second protrusion 64 is positioned through the second ground plane hole 84 and the second foam layer hole 94. Consequently the second tip 65 makes contact with the middle portion of the second dipole element 2. Accordingly, and in more detail, each of the pads 102, 104, 106, 108 on the second tip 65 is positioned in contact with a respective one of the contacts of a given dipole element, for example the contacts 32, 33, 34, 35. This positional contact is then converted into a full electrical contact by soldering the pads 102, 104, 106, 108 to their respective contact of the four contacts e.g. the contacts 32, 33, 34, 35. In this embodiment this soldering is done by applying heat to the thermal pads provided in the first copper film 52, e.g. the thermal pad 532 described earlier above. The applied heat is thermally conducted by the respective via, i.e. the via 110 in the case of the thermal pad 532, to the respective contact, i.e. the contact 32 in the case of the thermal pad 532. The conducted heat acts to heat the contact 32, and in this embodiment the solder wetting 119, such that the solder wetting 119 flows and then forms a full electrical contact between the contact 32 of the dipole array 100 and the respective pad of the second tip 65 of the second protrusion 64 of the pillar board 152. In this embodiment, if any of the soldered joints are found to be imperfect, or e.g. any short-circuiting due to solder is found to have occurred, e.g. during testing, then the relevant contacts can be reworked manually by accessing the contacts from the outer side of the overall assembly using the reworking holes such as reworking hole 118 described earlier above.

In this embodiment, the first pad 102 and the second pad 104 are connected to a first Marchand balun (not shown), integrated into the first pillar board 152, via a first and second conducting layer of the first pillar board 152 respectively.

During operation, signals are sent between the first Marchand balun and the first horizontal pole 22 via the first conducting layer of the first pillar board 152, and between the first Marchand balun and the second horizontal pole 23 via the second conducting layer of the first pillar board 152. In other words, the first and second conducting layers of the pillar board 152 conduct signals between the first Marchand balun and the horizontal dipole of the second dipole element 2.

During operation, the first and second conducting layers conduct equal currents in opposite directions, i.e. the signals in the first and second conducting layers are equal in magnitude and opposite in phase (balanced). The first Marchand balun joins the balanced line formed by the first and second conducting layers to an unbalanced line, hereinafter referred to as the "first unbalanced line". The first unbalanced line comprises a first terminal connected to electrical ground (the ground plane box 154), and a further terminal carrying an unbalanced signal corresponding to signals in the first and second conducting layers, i.e. a signal of twice the magnitude of the corresponding signal carried by either the first or second conducting layer.

In this embodiment, part or all of the first unbalanced line is a first component of the connection arrangement 58. Thus, the first Marchand balun is connected to the transmit-receive module (not shown).

In other words balanced signals are sent between the first Marchand balun and the two arms of the horizontal dipole of the second dipole element 2. These signals are transformed into unbalanced signals with respect to ground (i.e. the first unbalanced signal). The unbalanced signals are sent between the first Marchand balun and the transmit-receive module (not shown) via the connection arrangement 58).

Also in this embodiment, the third pad 106 and the fourth pad 108 are connected to a second Marchand balun, integrated into the first pillar board 152, via a third and fourth conducting layer of the first pillar board 152 respectively.

During operation, signals are sent between the second Marchand balun and the first vertical pole 24 via the third conducting layer of the first pillar board 152, and between the second Marchand balun and the second vertical pole 25 via the fourth conducting layer of the first pillar board 152. In other words, the third and fourth conducting layers of the pillar board 152 conduct signals between the second March-and balun and the vertical dipole of the second dipole element 2.

During operation, the third and fourth conducting layers conduct equal currents in opposite directions, i.e. the signals in the third and fourth conducting layers are equal in magnitude and opposite in phase. The second Marchand balun joins the balanced line formed by the third and fourth conducting layers to an unbalanced line, hereinafter referred to as the "second unbalanced line". The second unbalanced line comprises a first terminal connected to electrical ground (the ground plane box 154), and a further terminal carrying an unbalanced signal corresponding signals in the third and fourth conducting layers, i.e. a signal of twice the magnitude of the corresponding signal carried by either the third and fourth conducting layer.

In this embodiment, part or all of the second unbalanced line is a second component of the connection arrangement 58. Thus, the second Marchand balun is connected to the transmit-receive module (not shown).

In other words balanced signals are sent between the second Marchand balun and the two arms of the vertical dipole of the second dipole element 2. These signals are transformed into unbalanced signals with respect to ground (i.e. the first unbalanced signal). The unbalanced signals are sent between the second Marchand balun and the transmit-receive module (not shown) via the connection arrangement 58.

Each pillar board, and each protrusion thereof, is arranged in substantially the same way as that described above for the second protrusion 65 of the first pillar board 152. In this embodiment each board is manufactured from Rogers Corp. 4350 woven glass reinforced ceramic filled thermosetting pre-impregnated ("prepreg") material.

In this embodiment, each pillar board comprises feeds for each pole of the relevant dipole elements, and integrated Marchand baluns which effectively transform microwave input signals such that the output to opposite pairs of dipole arms are fed in anti-phase over a wide range of frequencies. However, in other embodiments, second order baluns may be used which limit the bandwidth of the balun to around 3:1 (less than the element with a 4:1 bandwidth). Higher order baluns tend to advantageously provide greater bandwidth but add additional manufacturing complexity and tend to require more board space. It is not essential to use Marchand baluns, nevertheless the Marchand balun tends to be advantageous over other types of balun, such as the Y-Y balun, which tend to be too sensitive to manufacturing variations to deliver consistent microwave performance.

Thus, a feed structure 44 comprising multilayer microwave printed circuit board (PCB) pillar board, incorporating dual integrated Marchand baluns, for the purpose of driving a wide band array antenna (the dipole array 100) is provided. The feed structure 44 is suitable for sending signals from a transmit-receive module (not shown) to the dipole array 100 for onward transmission into free space by the dipole array 100. Also, the feed structure 44 is suitable for sending signals that are received at the dipole array 100 from the dipole array 100 to the transmit-receive module (not shown). The overall arrangement thus provides what is referred to as "reciprocal device" from an electrical perspective.

Any appropriate structure, in particular internal structure, of the pillar boards, including the details of the baluns integrated therein, may be used. In this embodiment, the internal structure and functionality is preferably as described in International Patent Application No. PCT/GB2008/051196 (International Publication Number WO2009/077791 A1), the contents of which are incorporated herein by reference.

Figure 15:
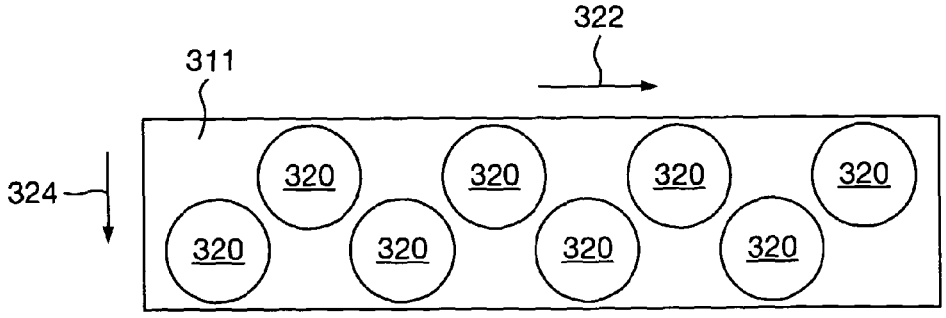
FIG. 15 shows schematically (not to scale) apertures as positioned on the top surface of a connector block.
Figure 14:
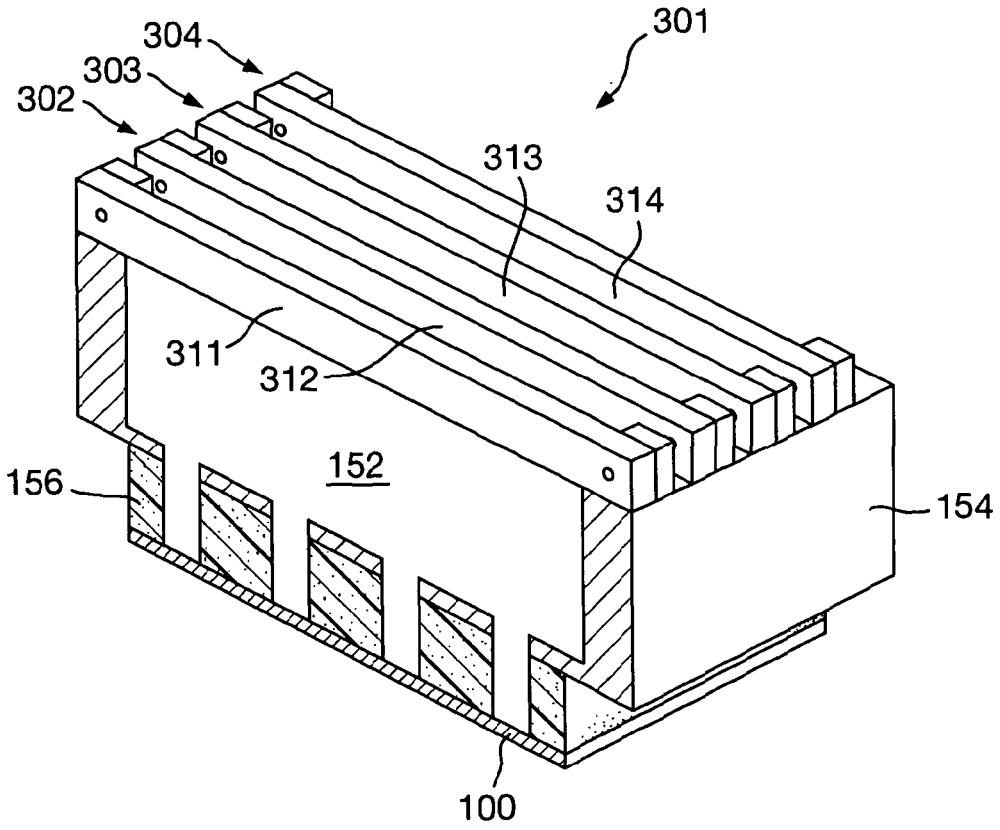
FIG. 14 is a schematic illustration of a perspective view of an assembled antenna array.

The particular form used in this embodiment for the above mentioned connection arrangement 58 will now be described with reference to FIGS. 14 and 15. FIG. 14 is a schematic illustration of a perspective view of an electrically scanned antenna 301 comprising the elements described above. The antenna 301 comprises the first pillar board 152, a second pillar board 302, a third pillar board 303, a fourth pillar board 304, the ground plane box 154, the foam layer 156, and the dipole array 100.

The first pillar board 152 is positioned in the first groove 72 of the ground plane box such that the each protrusion of the first pillar board passes through a respective hole in the ground plane box 154 as described above with reference to FIG. 12. Also, each protrusion of the first pillar board passes through a respective hole in the foam layer 156 such that each protrusion contacts the middle portion of a respective dipole element in the first row 10 of the dipole array 100 as described above.

The other pillar boards are arranged in a corresponding fashion, i.e. the second, third and fourth pillar boards 302, 303, 304 are positioned in the respective second, third and fourth grooves 74, 76, 78 such that the protrusions of the respective pillar board passes through the holes in the ground plane box 154 that lie along the along the respective groove. Also, the protrusions of the respective pillar boards pass through a respective set of holes in the foam layer 156 such that each protrusion of the second pillar board 302 contacts the middle portion of a respective dipole element in the second row 20 of the dipole array 100, each protrusion of the third pillar board 303 contacts the middle portion of a respective dipole element in the third row 30 of the dipole array 100, and each protrusion of the fourth pillar board 304 contacts the middle portion of a respective dipole element in the fourth row 20 of the dipole array 100.

In this embodiment, the edge of each pillar board that is opposite the edge having the protrusions is physically and electrically connected to a respective connector block 311, 312, 313, 314, i.e. the first pillar board 152 is attached to and electrically connected to a first connector block 311, the second pillar board 302 is attached to and electrically connected to a second connector block 312, the third pillar board 303 is attached to and electrically connected to a third connector block 313, and the fourth pillar board 304 is attached to and electrically connected to a fourth connector block 314. The connector blocks 311, 312, 313, 314 are made of gold plated aluminium.

In this embodiment, each pillar board is held in place with screws at the ends of the connector blocks and by a conductive epoxy applied between the protrusions of the pillar boards in order to permanently bond them to the box itself.

In this embodiment, apertures (not shown in FIG. 14) are machined into the connector blocks 311, 312, 313, 314. The apertures align with the conductor layers in the pillar boards leading to the Marchand balun inputs in order to allow the dipoles to be fed with (or send back) microwave radiation. In this embodiment, an "SMP" connector (Sub-Miniature Version P, where "P" stands for "push-fit") is fitted in each aperture 320 to provide the above described electrical connection to the connector block. In operation, an external transmit-receive module (not shown) is coupled to the SMP connectors by co-axial cables.

A pair of apertures (i.e. a pair of SMP connectors) is provided for each protrusion (being one cable for each polarisation). In this embodiment the conductive layers for the different polarisations exist on opposite sides of each board. Advantageously, in this embodiment the apertures (and hence the SMP connectors) are positioned offset relative to each other. FIG. 15 shows schematically (not to scale) such apertures 320 as positioned on the top surface of, for example, the connector block 311. In terms of the plane defined by the top surface of the connector block 311, consecutive apertures 320 are positioned offset to each other in the width direction of the top surface (indicated by reference numeral 322), such that overall the (in this example) eight apertures may be fitted into a shorter length in the length direction (indicated by reference numeral 322) of the top surface than would be the case if the layout was not staggered. This advantageously provides that the pillar boards may be closer together, which tends to allow for high frequency operation. In other words, in this embodiment microwave connectors (e.g. SMP connectors) are staggered to allow array elements to be brought closer together. This tends to facilitate high frequency operation and also allows signals to be taken from both sides of a microwave PCB pillar board for dual polar function from a single board.

Thus, in this embodiment, the connection arrangement 58 comprises the above described connector blocks 311, 312, 313, 314, along with their SMP connectors, and co-axial connections from the SMP connectors to e.g. an external transmit-receive module.

In this embodiment, the foam layer 156 comprises a layer of Rohacell HF31 foam. This layer incorporates 'floating posts' which advantageously tend to provide for common mode current suppression between elements. These prevent the formation of significant surface currents in apertures which effectively remove energy which might otherwise radiate. Thus, the active match, i.e. the impedance match of the antenna to free-space when powered, tends to be improved.

Also, as described above with reference to FIG. 12, the foam layer 156 is approximately 11.7 mm thick. Thus, in the assembled transceiver 301, the dipole array 100 is separated from the ground plane box 154 by a distance of approximately 11.7 mm. This distance corresponds to about one tenth of a wavelength at the lowest frequency of operation, this being designed so as to tend to maximise the operational frequency bandwidth. Thus, more generally, in other embodiments, the foam layer thickness may be selected in response to the intended frequency of operation.

The pillar boards are bonded such that any poorly performing elements are placed around the periphery. This advantageously tends to provide that the contribution of the poorly performing elements to the overall performance of the antenna is reduced.

In this embodiment, a layer of Technibond™ 235 supported acrylic film adhesive is used to bond the foam layer 156 to the ground plane box 154, and to bond the foam layer 156 to the dipole array 100.

In addition to the dipole array 100 being bonded to the foam layer, each pad of each pillar board is soldered to the corresponding contact in a dipole element. This advantageously provides a good electrical connection between the dipole elements and the feed structure 44.

The above mentioned through-vias, for example the via 110, advantageously provide for effective heat transfer through a material with a low thermal conductivity (the LCP layers of the dipole array 100). This tends to allow solder applied to the contacts of the dipole array 100 prior to the bonding of the foam layer 156 to the dipole array 100, to be re-melted after the bonding of the foam layer 156 to the dipole array 100, by the application of heat to an underside of the contact, i.e. by indirect heating. This allows the solder to flow and form an electrically conductive bond between the contact and the corresponding pad. This advantageous soldering technique allows soldering, including use of automatic soldering techniques, to be carried out even though the dipole contacts are remote from the soldering heat source.

In this embodiment, a protective layer (not shown) is bonded to the outer surface of the dipole array 100, i.e. the surface of the dipole array not bonded to the foam layer 156. In this embodiment, the protective layer comprises a 4 mm thick layer of Rohacell IG71 foam, and a 0.5 mm thick layer of Taconic RF-45. This advantageously tends to provide environmental and impact protection to the dipole array 100, as well as further impedance matching between the assembly 301 and free space.

Thus, a microwave array antenna containing a dual polarised feed structure 44 is provided. The feed structure 44 uses protrusions of a PCB pillar board as a mechanism to convey microwave radiation to antenna elements (dipole elements) which are perpendicular to the feed.

In the above embodiment, the transceiver comprises a ground plane box, a foam layer, a dipole array comprising sixteen dipole elements arranged in four rows of four elements, four pillar boards, and four connector blocks. However, in other embodiments the transceiver may contain other numbers of dipole array elements, ground plane boxes, foam layers, pillar boards, connector blocks, and so on. For example, in a preferred embodiment, the array may comprise a few thousand dual polarised elements, with the number of pillar boards and connector boxes determined such as to accommodate such an array size, in a layout suitable for the particular application under consideration.

In the above embodiment, the dipole array, the ground plane box, the foam layer, the pillar boards and the connector blocks are made from the materials specified above. However, in other embodiments some, or all, of the dipole array, the ground plane box, the foam layer, the pillar boards and the connector blocks are made from different appropriate materials.

In the above embodiment, the dipole array, the ground plane box, the foam layer, the pillar boards are of the shapes and dimensions specified above. However, in other embodiments some, or all, of the dipole array, the ground plane box, the foam layer, the pillar boards and the connector blocks are of different appropriate shapes, with different appropriate dimensions, such that the same functionality is achieved.

Also, in other embodiments the ground plane box and the foam layer comprise any number of holes, appropriately spaced such that some, or all, of the any number of dipole elements may be accessed through these holes.

Furthermore, in other embodiments any number of pillar boards, each comprising any number of protrusions for contacting the any number of dipole elements, is used. In other embodiments, a plurality of pillar boards may be joined together joined together using, for example by clamping the pillar boards together using a connector board the length of sum of the lengths of the individual pillar boards being joined. An assembly jig may be used to facilitate this joining of pillar boards.

In the above embodiment, the copper films are patterned photolithographically. However, this need not be the case, and in other embodiments, other patterning techniques may be used.

In the above embodiment, the pads on the tips of the protrusions of the pillar boards are electrically connected to the contacts of the dipole elements by soldering. However, this need not be the case, and in other embodiments, other techniques may be used, for example using conductive adhesives. Such conductive adhesives may be activated by heating, in which case such heating may be applied remote from the adhesive by applying the heat using the above described vias, as was the case in the soldering example above. However, in other embodiments where the conducting adhesive, or other appropriate method, does not require heat, then the vias and thermal pads described above may be omitted. Another possibility where the vias and the thermal pads described above may be omitted is if all of the soldering (or other heat applying technique) is done using the earlier described reworking holes.

In the above embodiment, the dipole array is fabricated using the process described above. However, in other embodiments the dipole array is fabricated using a different appropriate method, for example may be simplified to a monolithic structure with conductors deposited on either or just a single side. In other embodiments, the fabrication method for comprising the dipole array comprises some, all or none of the above described method steps.

In the above embodiment, the dipole array was fabricated using layers of Liquid Crystal Polymer (LCP). However, in other embodiments a different appropriate material is used. For example, in other embodiments a material with a similar thickness and complex relative permittivity, such as Taconic HyRelex TF290, is used and may provide improved performance. The dimensional stability in this layer tends to be important since small variations from element to element sum over the dipole array surface to potentially produce large inaccuracies such that dipole elements do not line up with the corresponding tips of the pillar boards. The use of the materials specified tends to avoid this problem. Furthermore, it tends to be particularly advantageous to match the coefficient of thermal expansion of these layers to those of other materials, in particular that of the ground plane box. Doing this tends to minimise the internal stresses within the transceiver resulting from operating at varying temperatures. The use of the materials specified tends to avoid this problem.

In the above description the various embodiments of feed arrangement, fixture, and the like, have been described in conjunction with a dipole array of substantially triangular poles (or other shapes providing highly coupled dipole effects as described earlier above). However, it will be appreciated that such dipole shapes are not essential, and in other embodiments other types of planar arrays of antenna elements may be used instead of the highly coupled ones described above, including conventional planar arrays of antenna elements with conventionally shaped antenna elements.

The invention claimed is:

1. An antenna assembly, comprising:

a layered stack structure having a planar array of antenna elements; and a planar multi-layered feed arrangement comprising a plurality of planar feed boards, each provided in a plane that is at an angle to a plane of the antenna elements;

wherein the layered stack structure further includes one or more upper layers over the planar array of antenna elements, and wherein holes are provided through the one or more upper layers to allow the feed arrangement to be connected to contacts for the planar array of antenna elements, and wherein the layered stack structure further includes one or more lower layers under the planar array of antenna elements, and includes vias under the planar array of antenna elements adapted to enable heat to be applied remotely through the vias to the contacts for the array of antenna elements to connect the contacts electrically to the feed arrangement.

2. An antenna assembly according to claim 1, wherein the feed arrangement is provided in a plane that is substantially perpendicular to the plane of the antenna elements.

3. An antenna assembly according to claim 1, wherein the vias are configured for applying heat for soldering.

4. An antenna assembly, comprising:

a layered stack structure including a planar array of antenna elements;

a feed arrangement comprising a plurality of planar feed boards, each provided in a plane that is at an angle to the plane of the antenna elements; and a fixture securing the planar array of antenna elements and the feed arrangement, wherein the fixture includes a ground plane box having a ground plane and sides, wherein the layered stack structure further includes one or more upper layers over the planar array of antenna elements, and wherein holes are provided through the one or more upper layers to allow the feed arrangement to be connected to contacts for the planar array of antenna elements, and wherein the layered structure further includes one or more lower layers under the planar array of antenna elements, and includes vias under the planar array of antenna elements provided such that heat may be applied remotely through the vias to the contacts for the array of antenna elements to connect the contacts electrically to the feed arrangement.

5. An antenna assembly according to claim 4, wherein the ground plane comprises:

grooves for positioning therein parts of the feed arrangement.

6. An antenna assembly according to claim 4, wherein the ground plane comprises:

holes for parts of the feed arrangement to pass through.

7. An antenna assembly according to claim 4, wherein the ground plane box is made of aluminum.

8. An antenna assembly according to claim 4, wherein the ground plane and the planar array of antenna elements are separated by a distance approximately equal to one tenth of a wavelength of an intended lowest frequency of operation.

9. An antenna assembly according to claim 4, comprising electrical connector blocks connected to parts of the feed arrangement, the electrical connector blocks providing transmission connection into and/or away from the antenna assembly and the electrical connector blocks providing mechanical fixing of the parts of feed arrangement relative to the ground plane box.

10. An antenna assembly according to claim 9, wherein the connector blocks comprise:

apertures for connections that are positioned offset relative to each other.

11. An antenna assembly according to claim 10, wherein the feed arrangement comprises:

one or more multilayer printed circuit boards.

12. An antenna assembly according to claim 4, comprising:

electrical connector blocks connected to parts of the feed arrangement, the electrical connector blocks providing transmission connection into and/or away from the antenna assembly, and the electrical connector blocks further providing mechanical fixing of the parts of the feed arrangement relative to the ground plane box.

13. An antenna assembly, comprising:

a layered stack structure comprising a planar array of antenna elements; and a planar multi-layered feed arrangement comprising a plurality of planar feed boards, each provided in a plane that is at an angle to the plane of the antenna elements;

wherein the layered stack structure further comprises one or more upper layers over the planar array of antenna elements, and wherein holes are provided through the one or more upper layers to allow the feed arrangement to be connected to contacts for the planar array of antenna elements, and wherein the layered structure further comprises one or more lower layers under the planar array of antenna elements, and further comprises vias under the planar array of antenna elements adapted to enable heat to be applied remotely through the vias to the contacts for the array of antenna elements to connect the contacts electrically to the feed arrangement, wherein each via comprises a thermal contact pad extending from a first end of the via, the first end being at the opposite end of the via to the end for connecting to the respective antenna element contact, the thermal contact pad being accessible from outside of the assembly.

* * * * *